US006957931B2

(12) United States Patent
Slater

(10) Patent No.: US 6,957,931 B2
(45) Date of Patent: Oct. 25, 2005

(54) ROOF BOLT BEARING PLATE AND METHOD FOR AN UNDERGROUND MINE

(76) Inventor: Bert W. Slater, 193 Third Ave., Indiana, PA (US) 15701

( * ) Notice: Subject to any disclaimer, the term of this patent is extended or adjusted under 35 U.S.C. 154(b) by 0 days.

(21) Appl. No.: 10/619,232

(22) Filed: Jul. 14, 2003

(65) Prior Publication Data

US 2005/0013672 A1 Jan. 20, 2005

(51) Int. Cl.[7] ..... E21D 21/02; F16B 43/00
(52) U.S. Cl. ..... 405/302.1; 411/544
(58) Field of Search ..... 405/259.1, 302.1–302.3, 405/303; 411/531, 533, 544, 546

(56) References Cited

U.S. PATENT DOCUMENTS

| | | | | | |
|---|---|---|---|---|---|
| 3,224,202 | A | | 12/1965 | Durget | 405/302.1 |
| 3,918,233 | A | | 11/1975 | Simpson | 52/745.07 |
| 4,293,243 | A | * | 10/1981 | Graybeal et al. | 405/259.1 |
| D275,452 | S | | 9/1984 | Payne | D8/399 |
| 4,518,232 | A | | 5/1985 | Dagenais | 405/302.1 |
| 4,520,606 | A | | 6/1985 | Francovitch | 52/410 |
| 4,708,559 | A | * | 11/1987 | Locotos | 411/545 |
| 4,780,039 | A | * | 10/1988 | Hartman | 411/531 |
| D301,687 | S | | 6/1989 | Cassidy et al. | D8/399 |
| 4,987,714 | A | | 1/1991 | Lemke | 52/410 |
| 5,207,535 | A | | 5/1993 | Saab | 405/259.1 |
| 5,267,423 | A | * | 12/1993 | Giannuzzi | 52/410 |
| 5,556,234 | A | * | 9/1996 | Oldsen et al. | 405/259.1 |
| 5,628,587 | A | * | 5/1997 | Lesslie | 405/302.1 |
| D388,193 | S | | 12/1997 | Villaescusa | D25/133 |
| 5,769,570 | A | | 6/1998 | Stankus et al. | 405/302.1 |
| 5,803,693 | A | * | 9/1998 | Choiniere et al. | 411/537 |
| 6,282,857 | B1 | * | 9/2001 | Rubenacker | 52/410 |
| 6,665,991 | B2 | * | 12/2003 | Hasan | 52/410 |
| 6,682,268 | B2 | * | 1/2004 | Robertson et al. | 405/259.1 |
| 2002/0028113 | A1 | | 3/2002 | Robertson et al. | 405/259.1 |

* cited by examiner

*Primary Examiner*—Thomas B. Will
*Assistant Examiner*—Tara L. Mayo
(74) *Attorney, Agent, or Firm*—Douglas G. Glantz

(57) ABSTRACT

Roof bolt bearing plate and method are disclosed for use in underground mining operations. A dome-shaped roof bolt bearing plate and method support the roof in a mine. The bearing plate is round or elliptical different from conventional commercial roof support devices. No dangerous edges and corners protrude downward. A recessed center is lower than the outer rim. A thin outer rim conforms to roof irregularities. The roof bolt bearing plate and method have been found to provide important advantages over conventional commercial roof support devices, including (1) concealing the head of the roof bolt to a preferred degree, (2) conforming to the roof's irregularities which will cause causing the plate to remain tight, (3) provide readability so the installer can to determine the quality and integrity of installation and anchorage, and (4) compressing the lower strata of the mine roof, thereby and creating a beam like support for the upper layers of the mine roof.

14 Claims, 9 Drawing Sheets

ROOF BOLT BEARING PLATE AND METHOD FOR AN UNDERGROUND MINE

BACKGROUND OF THE INVENTION

1. Technical Field

This invention relates to a roof bolt bearing plate and method for use in underground mining operations. In one aspect, this invention relates to a roof bolt bearing plate and method for supporting the roof in an underground coal mine.

2. Background

Mining operations today use roof bolt bearing plates to support the roofs in underground mines.

Support integrity for the mine roof provides a safe work place and maintains the important safety required for working in an underground mine. Failure to control the stability of the roof of the mine leads to the majority of serious or fatal accidents occurring in underground mines in the United States today. Accidents involving major cave-ins of mine roofs have become less prevalent, but a fatal accident can occur from the falling of large rock from the roof of a mine. Accordingly, mine roof control systems must provide safety integrity for personnel working in the mines. The Mine Safety and Health Administration (MSHA) of the United States government enforces mine safety standards, including roof support standards, and inspects mine roof control plans and practices in the mining industry.

Enhanced safety and roof support have reduced serious accidents involving major roof cave-ins substantially since the 1970's. Compliance with MSHA standards now requires underground mines to have a roof control plan in place, and such plan includes "primary roof support." Primary roof support includes abatement provisions designed to prevent a roof cave-in by sealing the lowest layers of a mine roof to upper strata of rock.

Methods for attaching lower level rock strata to upper layers use a roof bolt and epoxy resin to seal layers of rock strata. Roof bolts vary in length and size but are typically one-half inch or more in diameter and 30 inches to 12 feet long or longer in overall length. A motorized roof bolter places a roof bolt in a roof ceiling. Positioned in the front, unprotected face of the mine, a drilling mechanism drills several feet up through the mine roof. After a hole is placed in the roof, an epoxy resin in a pliable plastic tube is inserted in the hole. Next, a roof bolt is placed in the hole, and the placing of the roof bolt tears the packaging for the epoxy resin and mixes the resin to the bolt itself and the surrounding rock layers. The epoxy resin typically "sets up" or hardens within a matter of seconds, and the bolt and rock layers are sealed to each other.

In most underground mining situations, a roof bolt is placed approximately every four feet in the mine. Accordingly, placement of the roof support is a major undertaking and a major source of expense for the mine operator. Despite the cost, roof bolt and epoxy combinations are the conventional means for providing primary roof support and meet the requirements promulgated by MSHA and various state enforcement authorities.

INTRODUCTION TO THE INVENTION

Roof plates available commercially today can be viewed as severely limited with respect to the ability to compress the roof strata surrounding a roof bolt and adjacent areas.

Saab U.S. Pat. No. 5,207,535 discloses a mesh screen over a threaded end of a rock bolt. The Saab device is not used to pressurize the roof surrounding the roof bolt or compress the broken and loose strata. Saab does not support the roof but only the mesh, and the mesh supports the loose rock. Saab does not prevent the rock from breaking away from the immediate area of the bolt. The flat design and the split-leg portions do not support the roof under any type of pressure.

Wilcox U.S. Pat. No. 4,518,282 discloses a square plate for flat roof conditions. As a square or rectangle plate, the Wilcox plate leaves sharp edges and corners protruding downward, thereby causing a hazard to persons if the plate is installed in uneven areas of the roof. The outer edge of the Wilcox type plate turns downward and pulls the plate away from the roof. In spite of the size of the plate, a large portion of the intended area is left unsupported by the bearing plate.

Stankus U.S. Pat. No. 5,769,570 discloses a square plate used in conjunction with a cable bolt. The Stankus type plate shows the center protruding downward to form a cone shape away from the roof face. The Stankus plate uses a washer to mate with the surface of the plate and the bolt head.

Robertson US 2002/0028113 A1 discloses a plate used as a secondary roof support in conjunction with the primary roof support. Robertson's plate is convex from the center to the plate to the outer edge. Robertson's plate has an umbrella effect when used in an area of uneven roof. The center is pushed beyond the level plane and causes the outside rim to protrude down and away from the roof leaving only the center contacting the roof.

Payne U.S. Design Pat. No. 275,452 and Cassidy U.S. Design Pat. No. 301,687 disclose a plate of one plane.

Francovitch U.S. Pat. No. 4,520,606 discloses in the construction field a water tight seal to the roof of buildings. The Francovitch device could not be used to support the roof in underground mines.

Simpson U.S. Pat. No. 3,918,233 joins panels for roof and walls in the construction field.

Villaescusa U.S. Design Pat. No. 388,193 discloses a plate with minimal contact to pressurize the roof when installed. The two sides are punched out to accept a "J" hook which leaves even less of the area on the sides actually to contact and pressurize the roof. A hump on all four corners remains off the roof when the plate is installed and serves no purpose in supporting or pressurizing the surrounding roof at the bolt. The Villaescusa plate allows air to concentrate on the base of the bolt and allows a so-called weathering effect to take place and leave the entire area unsupported and dangerous.

Lemke U.S. Pat. No. 4,987,714 discloses a device used in the construction field for securing roofing materials and making a water tight seal. The Lemke device is building material hardware and could not be used as an underground roof support in the mining industry.

Durget U.S. Pat. No. 3,224,202 discloses a filler to contact the roof and conform to the roof conditions. The Durget type of roof bolting is very expensive and time consuming.

Roof plates available commercially today can be viewed as severely limited with respect to personnel safety because of the plate's sharp edges and corners, which protrude downward when in uneven areas of the mine.

New apparatus and method are needed to provide a roof bolt plate which: a) will securely contact the roof and compress the roof to stabilize the area immediately adjacent to the roof bolt, and b) will not bend down from the roof, creating a hazard to personnel.

Accordingly, novel roof bolt plate apparatus and method are needed to overcome the drawbacks attributable to traditional roof bolt plates used in underground mines today.

Accordingly, new mining roof bolt plate apparatus and method are needed to overcome the deficiencies found in conventional systems.

It is an object of the present invention to provide novel roof bolt bearing plate apparatus and method for providing a roof support system in an underground mine.

It is an object of the present invention to provide novel roof bolt plate apparatus and method that will pressurize the roof and maintain constant pressure on the roof surrounding the roof bolt.

It is another object of the present invention to provide a safer and less hazardous roof bolt plate with a rim that bends upward, even on irregular surfaces, leaving no sharp edges or corners that protrude downward and can injure workers.

It is another object of the present invention to provide a roof bolt bearing plate apparatus and method that will maintain more even pressure on the roof by compensating for uneven roof conditions and to provide a roof bolt bearing plate that will not be loosened when passing equipment comes in contact with the plate or bolt head.

It is a further object of the present invention to provide a roof bolt bearing plate apparatus and method that will ensure proper installation by enabling the roof bolter to determine immediately the quality of anchorage into the upper strata as soon as a bolting machine is lowered from the roof bolt.

It is a further object of the present invention to provide a roof bolt bearing plate that will form a cone shape around the base of the roof bolt and eliminate the weathering effect by compressing the roof bolt and preventing air from deteriorating the area of the roof adjacent to the roof bolt.

These and other objects of the present invention will become apparent from the detailed description which follows.

SUMMARY OF THE INVENTION

The apparatus and method of the present invention provide novel method and device for primary roof support in an underground mine. The apparatus and method of the present invention provides roof support in an underground mine including a round, dome-shaped support member having an extended lateral surface for contacting an inside roof of an underground mine and a center aperture in the support member for accommodating a roof bolt such that the roof bolt can be passed through support member to secure the support member to the roof of the underground mine. A round, dome-shaped plate of preferred size and thickness preferably is adaptable to changing roof conditions in an underground mine and provides primary mine roof support. The round dome-shaped apparatus and method of the present invention increase the bearing surface in the positive contact area. The novel plate and method stabilize the immediate roof in an underground mine and hold constant pressure on the surrounding roof in all directions.

The apparatus and method of the present invention provide a primary mine roof support and stabilizing system to accommodate adverse weathering. Weathering is when the immediate roof around the roof bolt deteriorates after time and falls to the mine floor leaving the area unsupported by the roof bolts.

The apparatus and method of this invention provides a device for primary mine roof support which decreases the amount of injuries imposed on primary mine support members by producing a dome-shaped plate, unlike square or rectangular ones. The dome-shaped plate does not bend away from the roof and eliminates the hazard of mine support members hitting the sharp corners of bent plates.

The apparatus and method of the invention provides a primary mine support system which will apply equal support in all directions of the roof. A uniform pattern of roof bolting is essential for proper roof control. When installed in this manner, the roof bolting compresses the lower roof strata and creates a beam like effect that helps support the upper layers of roof.

The apparatus and method of the present invention provide an apparatus for primary mine roof support having a recessed center to reduce the possibility of contact with persons passing under the roof bolt head.

The apparatus and method of the present invention provide easier installation for the operator of the roof bolt machine. The operator monitors the bolts anchoring in the roof as the operator lowers the roof bolt machine away from the head of the bolt. Accordingly, the novel apparatus and method of the present invention serve to reduce personnel difficulty involved in transporting the device, so as to increase the likelihood that the device will be used by mine employees.

The apparatus and method of the present invention overcomes the disadvantages inherent in prior art methods and devices.

DETAILED DESCRIPTION

Figure 1:
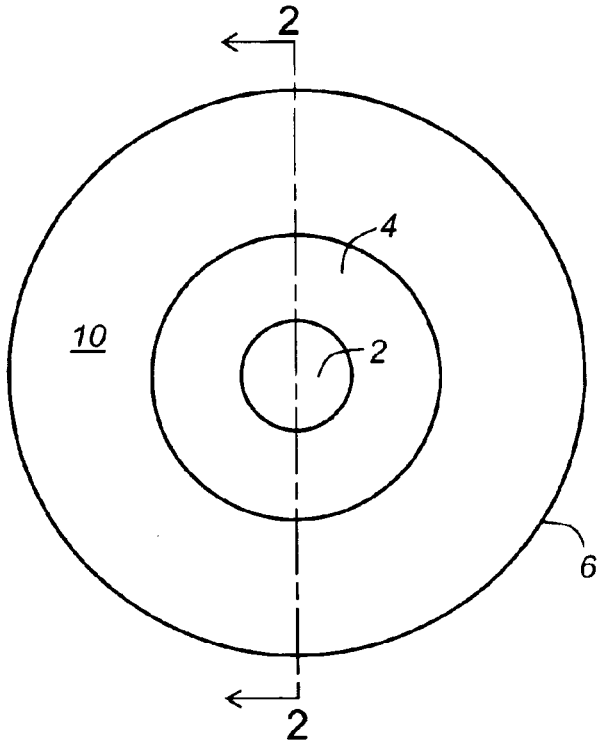
FIG. 1 depicts the points of contact between the safety plate and the roof of the underground mine.

In the mining of coal today, mining companies are finding the need to provide for enhanced safety and working conditions for the removal of larger and larger volumes and weights of mined material out of the mine. Apparatus and method must operate safely in the mine environment which typically subjects the miner personnel to a harsh and hostile environment.

In the mining of coal, particularly but not limited to coal strip mines, many coal seams are exposed and/or identified which have a low vertical seam height. By low vertical seam height is meant less than standing room. The low coal seam vertical height makes it extremely difficult or impossible to recover the coal by conventional deep mining equipment and techniques. The low coal is left behind when the cover over the seam is too high to mine the coal by strip mining techniques. Moreover, since the vertical height of these coal seams is so low, it is extremely difficult, if not impossible, to mine the low coal with people in the shaft.

It is therefore more imperative to provide more effective and safe roof bolts to protect miner personnel called to mine low coal.

In underground mining, and particularly in, but not limited to, underground mining wherein the vertical work space affords less than standing room, physical tasks are made more difficult by the confined spaces and constraints imposed by the underground mine. Although the apparatus and method of the present invention are not intended to be limited by particular dimensions in a low-coal mine, physical movements and activity are made significantly more demanding in low seam mining, e.g., less than 48 inches in vertical height.

When miners work to remove material from the mine in low coal, and when the miners apparatus is called upon to extend and retract in the mine, e.g., in conjunction with the continuous miner, the roof bolt plates must be constructed in the confining spaces and constraints within the mine, and conventional roof bolts and support apparatus are severely lacking in the areas of accommodating the difficult physical activities found in the confining spaces or constraints in the underground mine in low coal. The novel apparatus and method of the present invention facilitate rapid and flexible working conditions in the underground mine and increase mine prodcutivity.

Traditional roof bolt plates typically have a square or rectangle shape. The square shape causes sharp edges and protruding corners that cause a hazard to people if the plate is installed in an uneven area of the roof.

The roof of a mine is not a flat smooth surface. Grooves are left in the roof from the cutting machine bits, and ledges are formed from the rock falling and inconsistent operators. As the machine cuts the coal, a cutting bit scrapes the roof at different pressures and leaves different depths of gouges and ledges in the roof.

When a flat plate is used to support the roof in an underground mine, the center of the plate pulls up into the grooves and causes the outer edges to protrude downward. The flat plate has been found to leave a large percentage of the plate ineffective and to cause a hazard to persons in the lower coal seams.

Nearly every person working in the low seam mines has been injured to some extent by the plates that have the sides and corners protruding downward. The plate of the present invention will not protrude downward leaving a sharp edge to harm anyone, when the center is pulled into the grooves. The plate of the present invention has an outer rim which will stay tight to the roof and conform to the uneven areas. Square and rectangle plates that are not domed have a tendency to become loose when brushed by passing equipment and in turn are ineffective. The plate of the present invention will not become loose easily because of the constant pressure and conforming that takes place when the plate is tightened to the roof.

The apparatus and method of the present invention provide a novel roof bolt plate including a round, dome-shaped plate of preferred size and thickness adaptable to changing roof conditions in an underground mine. Novel plates are used in conjunction with various types and sizes. Novel plates of the present invention are made of metals now produced commercially. The plates are manufactured for the use of cable hangers and/or "J" hooks. A round dome-shaped design increases the bearing surface because of the positive contact area.

The novel rounded plate of the present invention provides a center of the plate recessed to a certain specified degree so that when the bolt and plate are installed, the outer rim of the plate contacts the roof first, and then as the bolt is tightened against the mine roof, the entire area around the bolt is compressed. The novel plate stabilizes the immediate roof by holding constant pressure on the surrounding roof in all directions. The novel plate design also eliminates a so-called weathering effect. Weathering is when the immediate roof around the roof bolt deteriorates after time and falls to the mine floor leaving the area unsupported by the roof bolts.

The recessed area in the center of the plate has a number of important benefits further to applying constant pressure to the outer rim and center of the novel plate. The recess also is useful in determining the quality of installation and the movement of the roof after the bolt has been installed by comparing the head of the bolt to the raised portion of the plate. The recess also protects the head of the bolt from possible damage done by passing equipment.

The novel roof bolt plate is substantially round instead of rectangular or square. The novel configuration increases the square inch coverage in all directions of the installed bolt. The plate is indented in the center with a through hole of different sizes for bolt insertion. The center indentation of the novel plate is displaced in structure lower than the outer rim so that the outer rim contacts the roof surface first. The lower center indentation provides the advantage when the bolt is installed, pushed to the roof, and tightened. A positive tension on the outer rim applies against the roof and the center of the plate against the roof. The indentation conceals some of the head of the roof bolt and aids in preventing damage to the bolt from equipment or harm to persons when passing under the installed bolt. The novel plate is punched out for the use of "J" hooks to hang cables. Plates for underground roof bolting support the roof and are punched out for the "J" hook or a similar device for hanging cables and wires.

The novel plate of the present invention provides novel outer rim contact. The rim of the plate is only as wide as the thickness of the material used to produce the plate. When the plate is installed, the outer rim contacts the roof first, and then as the bolt is being pushed to roof, the rim of the plate spreads out away from the center and pushes upwards on the roof at 30 to 45 degree angles. When the center of the plate is pushed to the roof and the bolt is set or tightened, the plate is seated firmly against the roof.

The apparatus and method of the present invention provide more coverage and support than conventional roof bolt plates. When the bolt is installed, the plate acts like a lock washer holding pressure on the roof and the head of the bolt. By holding tension on the roof and bolt head, the roof is compacted around the base of the bolt and eliminates the so-called weathering effect. The weathering effect when the roof deteriorates around the base of the bolt after time and falls to the bottom leaves the area unsupported and illegal. The novel plates of the present invention are made in a round or ellipse shape, although round is preferable because of the equal coverage and support in all directions.

It has been found that the indented center of the present invention provide further important advantages including to conceal and protect the head of the bolt from damage by passing equipment and further to prevent injuries caused by low hanging bolt heads. The bolt head is recessed in the center of the plate to a certain degree, which reduces the possibility of contact with persons passing under the bolt head. With visual observation, it is possible to determine if the roof was moving or the bolt has lost its anchorage, by noting the distance from the very end of the bolt head in comparison to the lower portion of the plate. It has been found to be particularly helpful when the bolt is being installed. The operator of the roof bolting machine is provided with the ability to determine when the bolts are anchoring in the roof as the operator lowers the machine away from the head of the bolt. If the plate pushes the bolt head downward, the bolt is not secured in the roof properly and the operator installs another bolt to replace the failed bolt, because of the lock washer effect. A machine bolt would show similar actions if the threads were stripped off of the bolt or nut and tightened on a lock washer.

Plates having a flange on the outside edge running parallel with the roof push perpendicular to the roof and compress the roof directly above the plate. Most of the pressure is in the center of the plate because the outside will bend away from the roof, as the center is being pushed. Square and rectangular plates have a tendency to bend away from the roof as they are being tightened in irregular or uneven roof. When the bending away happens, a large percentage of the coverage and support are lost. Moreover, the plate then has protruding sharp edges and corners facing downward, and becomes dangerous to the persons moving around the mine, especially in lower seams of coal. Many injuries have been caused by these hanging plates. Miners who have worked in low coal testify to injuries from sharp corners and edges from square and rectangle plates because they become loose with bumping by equipment passing under and brushing against the plate or bolt head. In fact, one test, which a coal mine inspector performs, is to hit the plate on the side with a hammer to test its tightness. If the plate is loose or becomes loose with the test, the bolt should be replaced and the inspector can insist on the replacement or repair of this bolt, which procedures are very expensive and time consuming.

The plate and method of the present invention do not leave sharp corners or edges because of the dome-shape and the rim forced into or flush with the roof. The novel equipment of the present invention is directed over the plate and bolt head and will be not dislodge and loosen. It has been found that the test the inspectors perform with a hammer does not loosen the novel plate of the present invention.

All underground mines are required to have a "roof control plan." The roof control plan dictates the minimum required roof support systems. All materials (roof bolts and roof plates) must be approved by MSHA (Mine Safety and Health Administration) before they can be used in underground mines as a primary roof control system. Anything above and beyond the minimum plan can be used without approval, which is called a supplementary system. The plate of the present invention will be used as a primary support and will require testing by MSHA.

Referring now to the drawings of the figures, the following identifying numerals list the items being references in the several figures.

2. Shows the aperture where roof bolt is installed into the plate, before installation in the mine roof.

4. Shows the recessed area in the roof bolt plate. This is the area that the bolt head will be recessed in the plate after the bolt is installed and compressed to the mine roof.

6. Shows the outer rim and first area of contact to the mine roof.

8. Shows how the pressure is applied to the plates outer rim when an upward force is applied to the center of the plate.

10. Designates the round dome shaped roof bolt plate.

12. Shows a square roof bolt plate.

14. Shows the rectangular roof bolt plate.

16. Shows the elliptical or oval shaped roof bolt plate.

18. Shows the mine roof, some with cutting machine grooves.

20. Shows the area of the roof pressurized by the roof bolt plates.

22. Designates the roof bolt.

24. Coal face or the area where the coal is being extracted.

26. Coal rib, the sides of the entries. That area is left standing to support the roof and direct ventilation.

28. Epoxy resin in a pliable plastic tube, made up of two equal parts, one the resin and the other the hardener, separated by a thin partition.

30. Immediate roof strata.

32. Predrilled hole.

34. Upper strata.

36. Aperture for "J" hooks.

38. Strengthen ribs. For extreme roof conditions.

40. Directions of pressure applied to the roof.

Referring now to FIG. 1, a sectionalized view A—A is shown of the contact area of mine roof 18 and safety plate 10. The first contact will be outer rim 6, and then center 4 will be forced to the roof 18 by the installation of a roof bolt 22. Safety plate 10 maintains pressure on mine roof 18 immediately adjacent to the roof bolt 22 and in all directions from that area.

Figure 2:
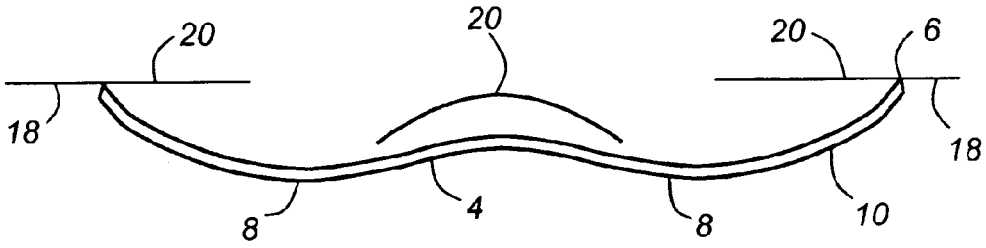
FIG. 2 shows Section A—A of FIG. 1.

FIG. 2 shows Section A—A of FIG. 1.

Figure 3:
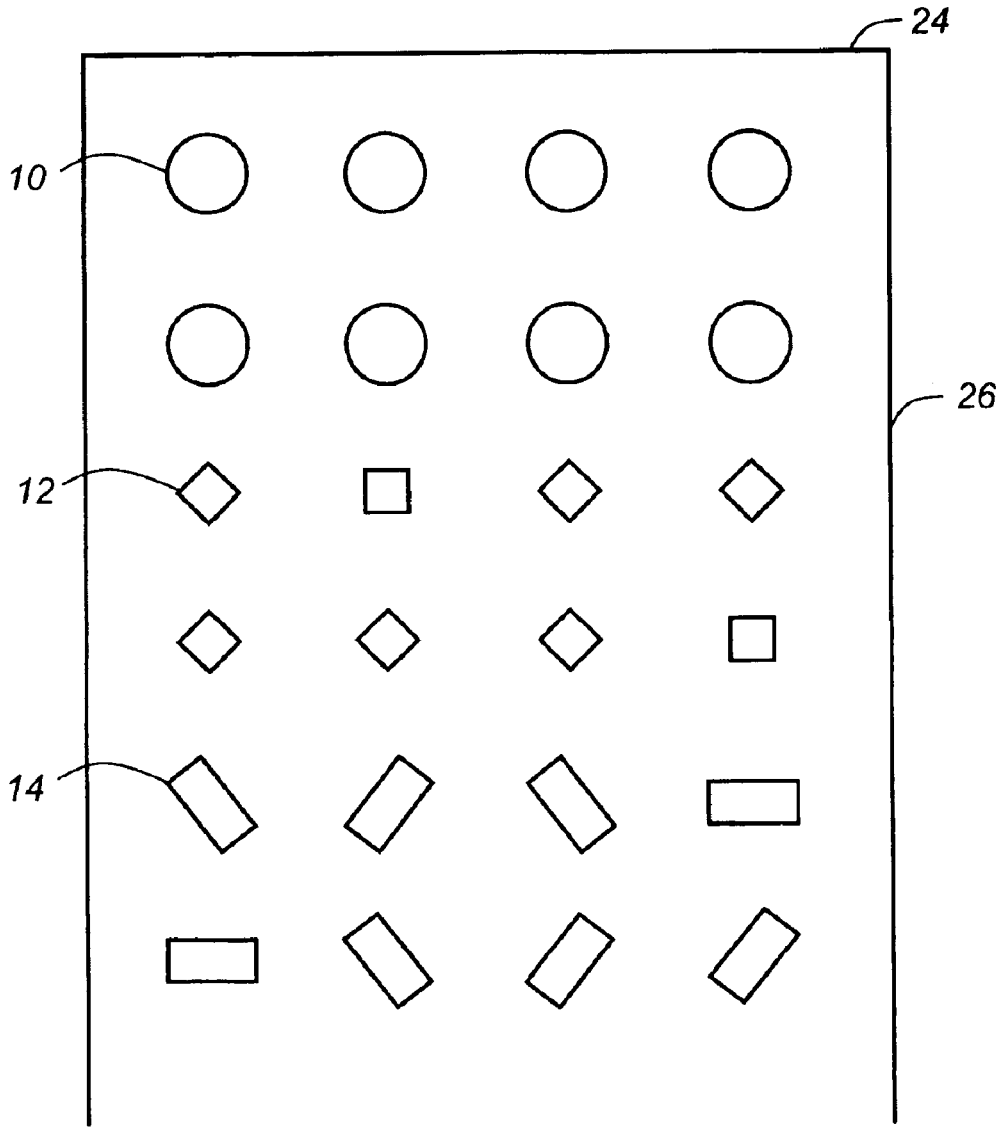
FIG. 3 shows the general placement pattern of roof bolts in an underground mine.

FIG. 3 shows the general pattern of the placement of roof bolts 22. The irregular pattern of square 12 and rectangle shaped plates 14 compare to round safety plates 10.

Referring now to FIG. 3, a consistent and uniform pattern is shown to form an essential part for proper and effective roof control.

Figure 4:
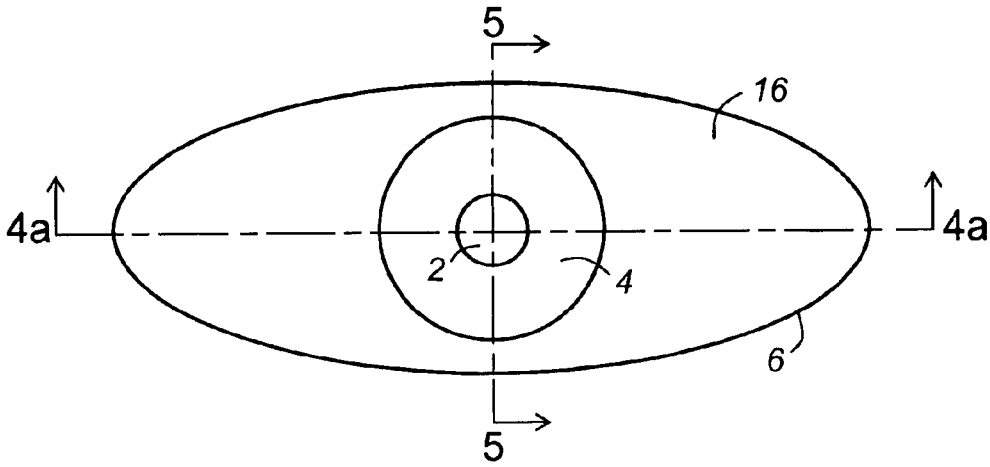
FIG. 4 shows a variation of the safety plate as an oval or elliptical plate that can be used as an alternative to the round plate when required.
Figure 4A:
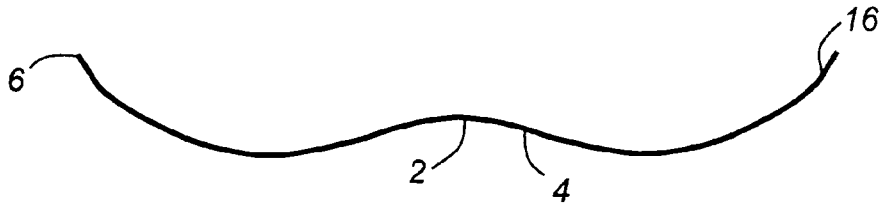

FIG. 4 shows the variations of the safety plate 10 of the present invention.

Referring now to FIG. 4, an elliptical/oval plate 16 can be used as an alternative to the round plate 10 when required. In areas of the mines where channels and cross bars are used to assist in the support of the roof or in areas in need of repairs, the oval plate 16 can be inserted between the crossbars and in channels when additional reinforcement is required. Sectionalized views A—A and B—B show the same beneficial dome-shape that the round plate 10 offers.

Figure 5:
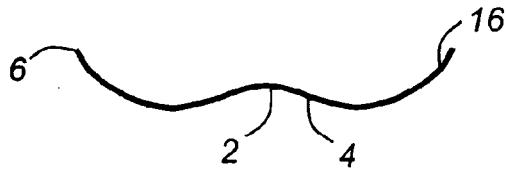
FIG. 5 shows Section B—B of FIG. 4.

FIG. 5 shows Section B—B of FIG. 4.

Figure 6:
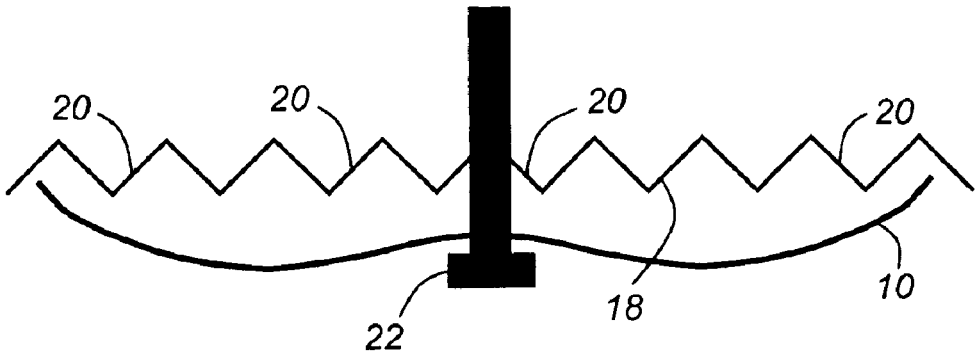
FIGS. 6 and 7 show the comparison between the square or rectangle plates to the safety plate (round dome-shaped plate) of the present invention.
Figure 7:
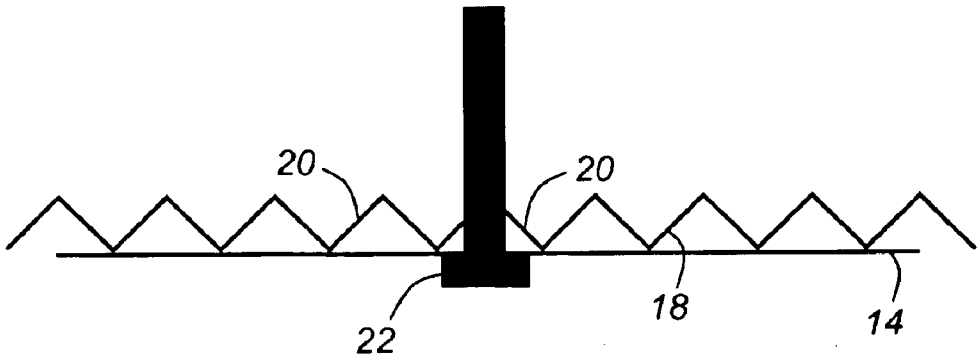

FIGS. 6 and 7 show the edges of safety plate 10 of the present invention and how it operates to hug the roof.

Referring now to FIGS. 6 and 7, the plate 10 of the present invention eliminates the hazards associated with the protruding edges of the conventional plates. As the center of the rectangular plate 14 is tightened to the roof of the mine, the edges of the plate 10 bend downward from the roof 18, leaving sharp edges and corners that protrude. This condition creates a hazard for workers moving about the mine. Often times, machine operators moving through the mine in a sitting position must tilt their heads even then missing the roof 18 by just inches.

Figure 8:
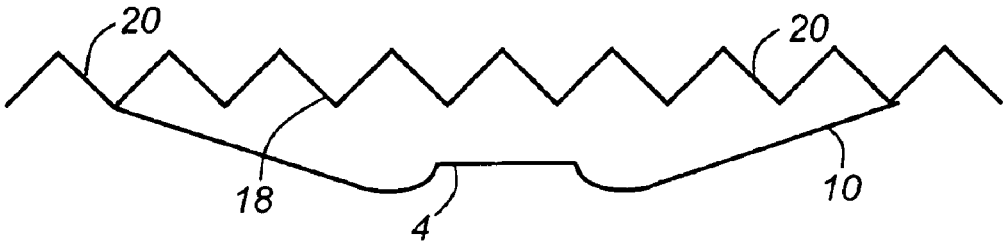
FIGS. 8 and 9 show the safety plate before and after the compression of the plate take place.
Figure 9:
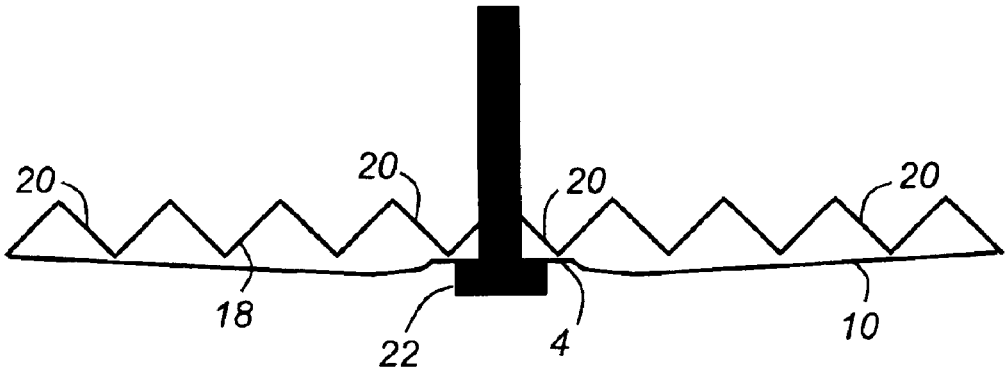

FIGS. 8 and 9 show a plate 10 pushed to the roof and compressed.

Referring now to FIGS. 8 and 9, as the dome-shaped plate 10 is bolted to the roof, the outer rim contacts the roof first 6. When the outer edge is tight, the center starts to compress 4, flattening the plate out. The plate 10 continues to pressurize the roof until the center of the plate is firmly seated against the roof. With the safety plate 10 of the present invention, the plate actually spreads out, conforming to the contours of safety plate 10.

Figure 10:
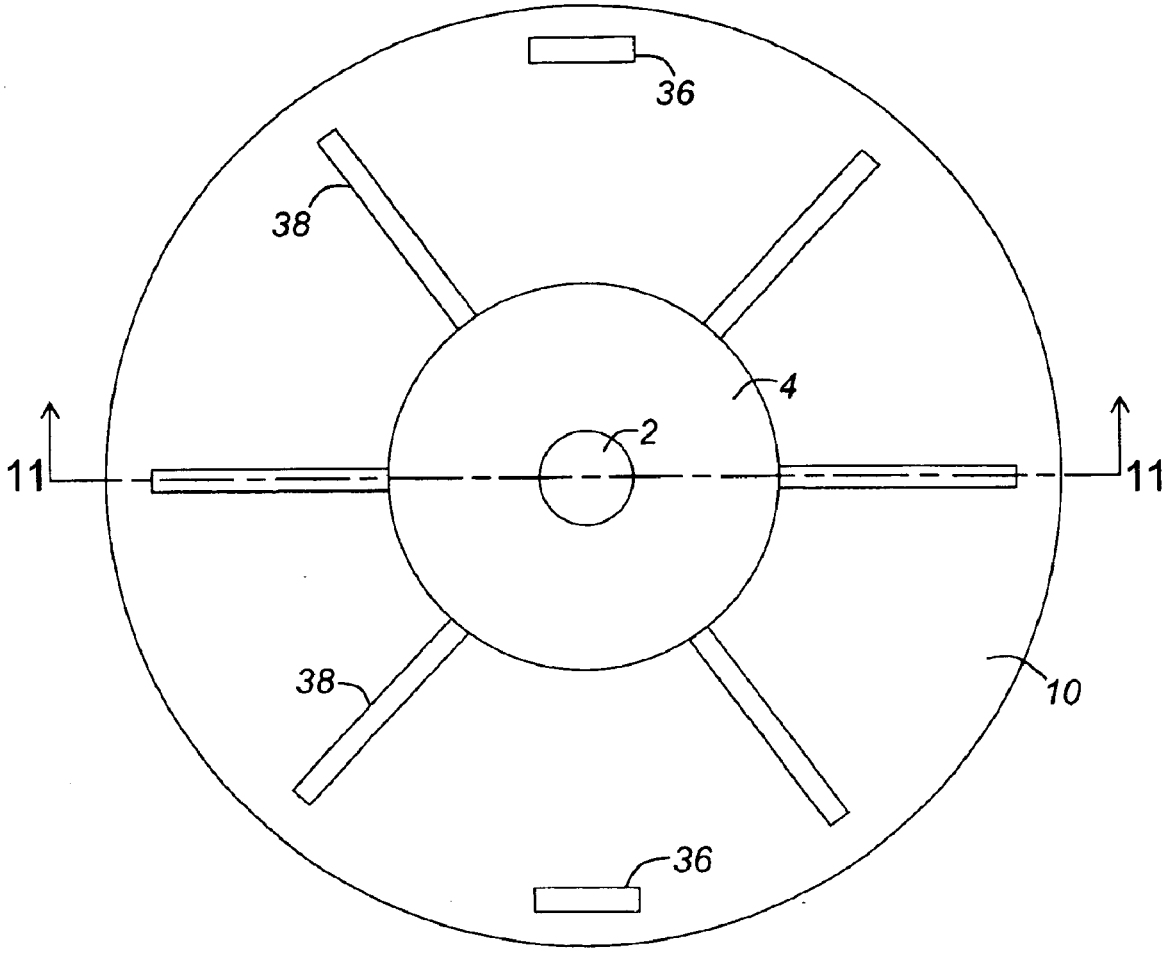
FIG. 10 shows an alternate model of the safety plate containing rib for extra strength.

FIG. 10 shows the alternate model of safety plate 10 of the present invention containing strengthening ribs 38.

Referring now to FIG. 10, strengthening ribs 38 are used, for example, in extraordinary roof conditions where a stronger plate is needed.

Figure 11:
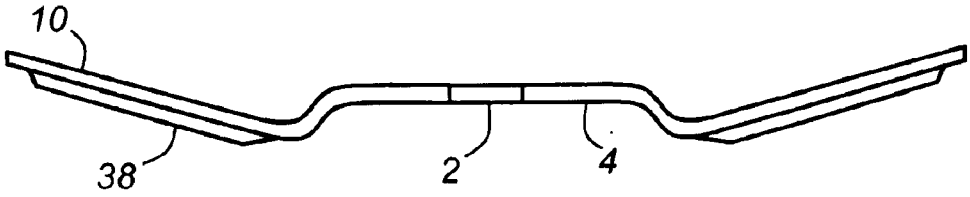
FIG. 11 shows Section A—A of FIG. 10.

FIG. 11 shows Section A—A of FIG. 10.

Figure 12:
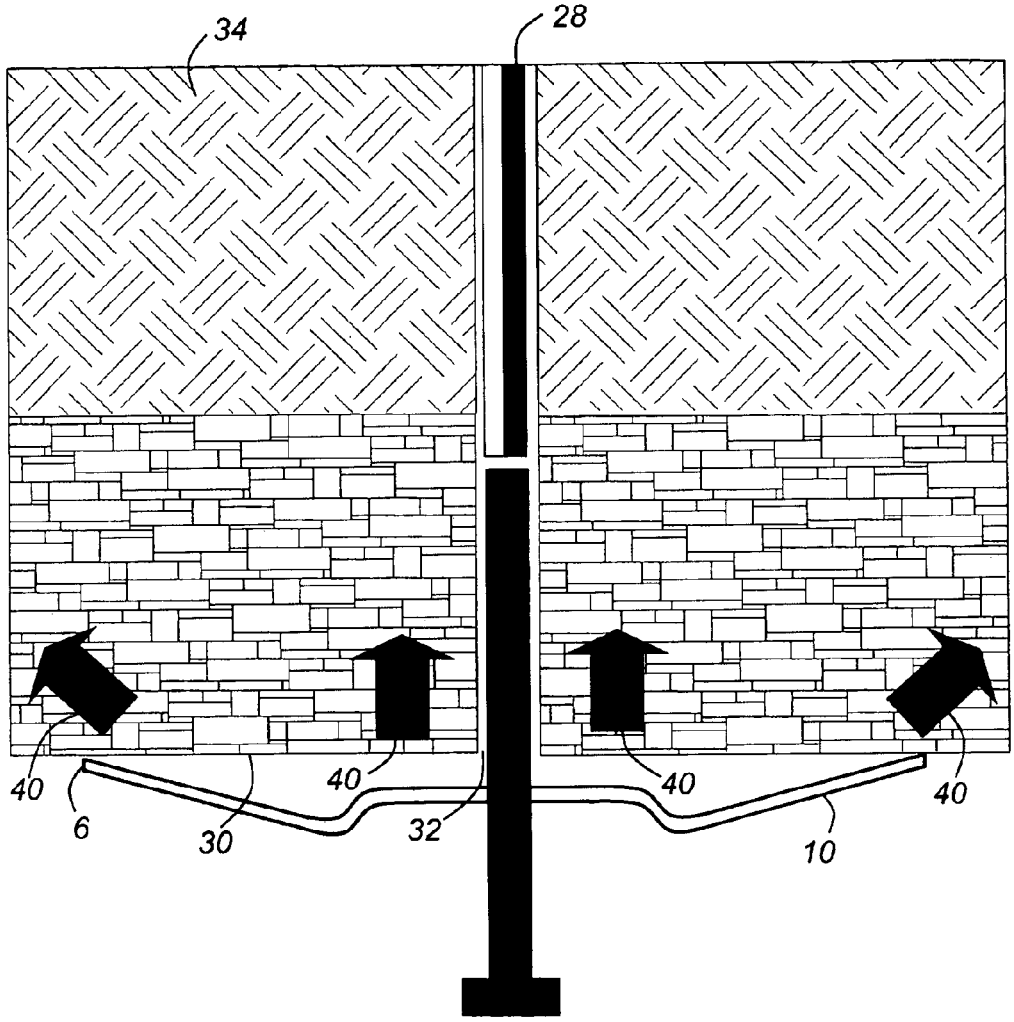
FIG. 12 shows the actual cross sectional view of the roof, roof bolt, epoxy resin, and the safety plate.

FIG. 12 shows the installation of safety plate 10 of the present invention when used with a roof bolt 22.

Referring now to FIG. 12, after epoxy resin 28 has been inserted into a predrilled hole 32, the bolting machine spins and forces the bolt into the hole, breaking and mixing the container of resin, and pushing the bolt 22 and plate 10 against the mine roof 18. After a few seconds, the bolt sets and hardens in the epoxy resin 28 inside the roof 18 and then remains tight. The plate's outer rim 6 sits against the roof 18, compressing strata 34 and tightening them firmly to the roof 18.

Figure 13:
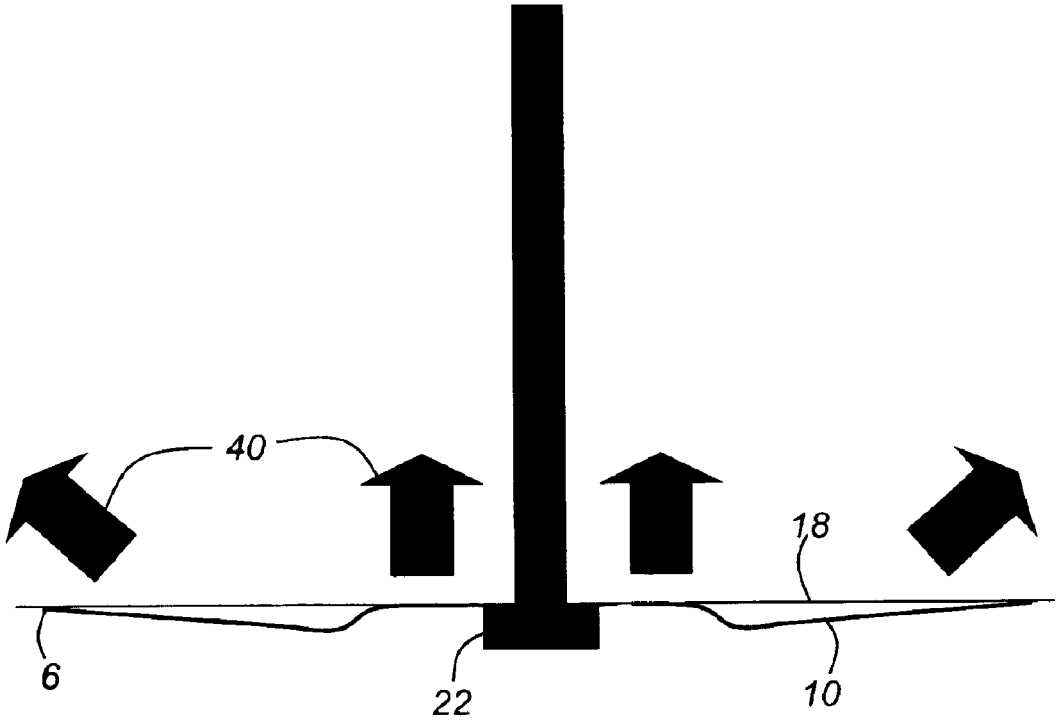
FIG. 13 shows a plate pushing on the roof at 30 to 45 degree angles in all directions around the plate and straight up the center.

FIG. 13 shows a plate 10 pushing on the roof at 30 to 45 degree angles in all directions around the plate 10 and straight up in the center.

Referring now to FIG. 13, as the safety plate 10 of the present invention of the present invention is tightened to the roof 18, the force applied to the center of the plate by the bolt causes the plates outer rim 6 to push up on the roof at a 30 to 45 degree angle. When the bolt 22 is secured, the plate 10 compresses directly above its center, which in turn, compresses the roof 18 in all directions 40 adjacent to the roof bolt 22.

Figure 14:
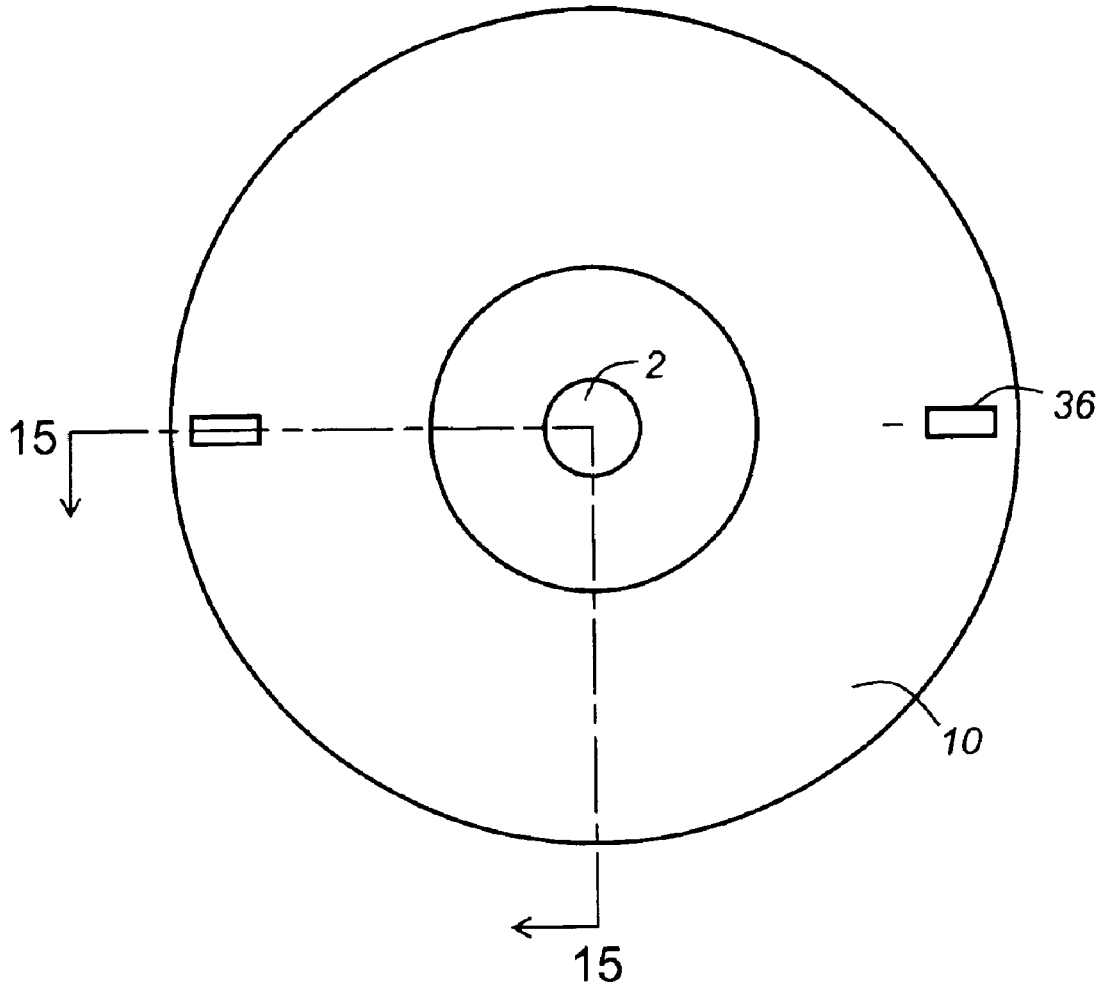
FIG. 14 shows the safety plate and locations of the "J" hook hangers.

FIG. 14 shows the safety plate 10 and locations of the apertures for "J" hook 36.

Figure 15:
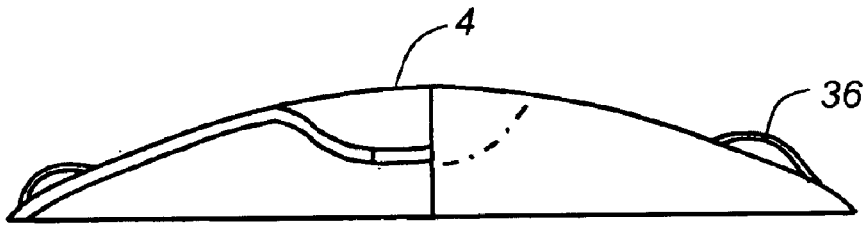
FIG. 15 shows Section B—B, a one quarter cut away view of FIG. 14.

FIG. 15 shows Section B—B of FIG. 14 with a quarter cut away view.

The roof plate of the present invention is made of a tough, abrasion-resistant material and a large outer diameter, e.g., such as by way of example, 7–12 inches outside diameter, and serves to provide greater square inch coverage in all directions of the installed roof bolt. The constant moving of machinery around the mine and friction against the roof greatly increases the wear and tear on the roof and increases the maintenance interval correspondingly.

In one aspect, the apparatus and method of the present invention preferably provide 36–113 square inches of roof coverage having 7–12 inches outside diameter (7–12" O.D.). The preferred embodiment includes a center aperture of one inch in diameter.

Sharp corner edges are avoided by not using the square or rectangle shaped plates. In one aspect, the present invention provides a thin rim, and the plate will conform to the roof and always bow upward toward the roof.

The present invention has the center set flush on the roof when the bolting procedure is completed and has a certain amount of the bolt head concealed by the upward indentation. The plate of the present invention is used as a primary roof support in all types of roof.

EXAMPLE

Roof bearing plates in accordance with the present invention were tested by the Mine Safety and Health Administrator. The procedure used by the MSHA to test these plates was to put the plate over a 4 inch hole, and a 1.75 inch ram is pushed in the center of the plate. The plate is preloaded to 6000 foot lbs., and then a measuring device is attached to the plate. The movement or displacement is recorded on a graph. The MSHA test is called the deflection test. After the 6000 foot lbs. force is applied to the plate, the movement can only be 0.120 inches from 6000 to 15000 foot lbs and 0.250 inches from 6000 to 20000 foot lbs. The plates performed as shown in table 1.

TABLE 1

| No. | Thickness (in.) | Center Hole Dia. (In.) | Displacement (in.) $6^k - 15^k$ (.120 max.) | Displacement (in.) $6^k - 20^k$ (.250 max.) | Strength (lbs.) Load at .250 in. | Strength (lbs.) Ult. Load (20,000 min.) |
|---|---|---|---|---|---|---|
| 1 | .132 | 1" | .022 | .062 | — | 24,100 |
| 2 | .131 | 1" | .024 | .059 | — | 24,300 |
| 3 | .133 | 1" | .014 | .053 | — | 25,300 |
| 4 | .133 | 1" | .032 | .070 | — | 25,400 |
| 5 | .131 | 1" | .039 | .062 | — | 29,700 |
| 6 | .133 | 1" | .025 | .054 | — | 25,000 |
| 7 | .133 | 1" | .022 | .063 | — | 24,000 |
| 8 | .133 | 1" | .030 | .066 | — | 25,900 |
| 9 | .133 | 1" | .026 | .065 | — | 24,700 |
| 10 | .133 | 1" | .030 | .064 | — | 25,200 |

TABLE 2

| No. | Thickness (in.) | Center Hole Dia. (In.) | Displacement (in.) $6^k - 15^k$ (.120 max.) | Displacement (in.) $6^k - 20^k$ (.250 max.) | Strength (lbs.) Load at .250 in. | Strength (lbs.) Ult. Load (20,000 min.) |
|---|---|---|---|---|---|---|
| 1 | .130 | 1" | .066 | .117 | — | 24,000 |
| 2 | .130 | 1" | .055 | .104 | — | 24,000 |
| 3 | .130 | 1" | .052 | .100 | 27,400 | 27,400 |

TABLE 2-continued

| No. | Thickness (in.) | Center Hole Dia. (In.) | Displacement (in.) $6^k - 15^k$ (.120 max.) | Displacement (in.) $6^k - 20^k$ (.250 max.) | Strength (lbs.) Load at .250 in. | Strength (lbs.) Ult. Load (20,000 min.) |
|---|---|---|---|---|---|---|
| 4 | .130 | 1" | .065 | .113 | 27,000 | 27,000 |
| 5 | .130 | 1" | .061 | .110 | 27,400 | 27,400 |
| 6 | .130 | 1" | .063 | .113 | 27,500 | 27,500 |
| 7 | .130 | 1" | .065 | .115 | 27,600 | 27,600 |
| 8 | .130 | 1" | .078 | .127 | 27,700 | 27,700 |
| 9 | .130 | 1" | — | — | — | 27,200 |
| 10 | .130 | 1" | .055 | .198 | 26,700 | 26,700 |

The present invention is used in underground mines to support the roof, during and after the mineral (coal) is extracted.

The apparatus of the present invention is a one piece plate that applies pressure to the roof surrounding a roof bolt as it is installed.

A roof bolt plate, when a roof bolt is installed, provides a larger area to suspend the roof, rather than just the head of the bolt, to prevent the immediate roof from crumbling and becoming unstable. The plate also compresses any cracks in the strata around the bolt and prevents air from entering the cracks and deteriorating the roof. The method of the present invention compresses the area by having the outer rim contact the roof first, and as the bolt is tightened, the plate applies pressure to the roof at a certain (30–45 degree) angle before the center contacts the roof. The roof bolt plate and method of the present invention spread the support out and up from the base of the bolt giving a broader support to the mine roof.

Weathering effect when the roof area around the base of a roof bolt and plate deteriorates and falls to the mine floor leaves a space between the plate and the remaining roof. The weathered area then is considered to be unsupported and unsafe. The method of the present invention cups the area and prevents the weathering condition by confining the immediate roof into a cone shape.

The apparatus and method of the present invention require no filler. The apparatus and method of the present invention operate to have the plate compress the roof and surrounding area by plate to roof contact in as many points as possible. In the apparatus and method of the present invention, the plate bends to conform to the roof and hold pressure between the roof and the plate. By having the plate bend, the plate apparatus and method of the present invention then acts as a lock washer for the bolt and will not allow the plate to loosen. As the plate of the present invention is tightened, the outer rim will not bend away from the roof.

In one aspect, the apparatus and method of the present invention provide increased safety because the safety plate's recessed center conceals the roof bolt head when installed and edges that press against the roof In one aspect, the apparatus and method of the present invention provide improved safety of personnel by preventing or greatly reducing the number of injuries caused by contact with sharp edges and corners.

In one aspect, the apparatus and method of the present invention provide a substantial reduction in or elimination of the "weathering-effect" by compressing the roof more effectively The novel mining apparatus and method of the present invention provide increased safety, greater coverage and support of the mine roof, longer lasting components, fewer injuries, and more successful inspections as a result.

I have found that the safety plate of the present invention adheres tightly to the roof. Because of a lock washer effect, the safety plate of the present invention remains tight even when the inspector attempts to loosen it during testing. Many conventional plates become loose and can be rotated, even immediately after installation. Such plates offer inadequate adhesion and require immediate repair or replacement. By contrast, when the safety plate of the present invention is installed, i.e., the roof bolt is pushed to the roof, the plate adheres tightly to the roof.

The novel mining apparatus of the present invention provide a preferred advantage over conventional apparatus. Workers who have toiled in the dark, confined spaces and constraints, often times working in muck and mire, appreciate the feature of increased ceiling height and elimination of dangerous corners and edges with the safety plate, and these features reduce the number and severity of injuries.

The novel mining apparatus and method of the present invention not only provide a more secure, safer work environment through greater support and fewer injuries, but also reduce the need for repair and replacement of roof bolts, and further also supply a positive means of roof control easily monitored by installers, inspectors, and mine examiners.

The roof bolt and plate combination of the present invention provide enhanced safety for a mining system for low coal seams, e.g., such as less than about 48 inches in vertical height. The low coal seams make it extremely difficult for physical activity in the confining spaces and constraints of the underground mine. Every physical effort is magnified many fold in difficulty level by the confining spaces of the low coal.

In one embodiment, the roof bolt and plate provide an effective, low cost means of increasing worker safety and conforming to regulations while extending the life of the roof support system of the mine.

The novel mining apparatus and method of the present invention are capable of providing not only a recessed area, which conceals most of the roof bolt head, but also an outer rim contact area that compresses the roof as the bolt is tightened.

In one aspect, the present invention includes an efficient method to hang cables and wires, thereby to protect power cables from damage by not being run over by equipment.

I have found that the apparatus and method of the present invention permit use in a wide variety of roof conditions, including roofs that are loose or broken regardless of the condition of the roof. The safety plate of the present invention compresses the area, preventing air from entering and deteriorating the roof.

I have found empirically that the combination insert of the present invention allows for use in a low height mine where space is limited.

I also have found that the combination insert of the present invention allows for use in all types of roof conditions, even extremely broken roof strata.

The novel apparatus and method of the present invention accordingly are significantly preferred over conventional apparatus and methods which typically result in significantly less maintenance and repair of areas of the mine that have been weathered and deteriorated over time.

The apparatus and method of the present invention are not intended to be limited to the descriptions of specific embodiments herein above, but rather the apparatus and method of the present invention should be viewed in terms of the claims which follow and equivalents thereof.

What is claimed is:

1. An apparatus for providing a primary roof control support in an underground mine, comprising:

(a) a round or oval dome-shaped bearing plate for contacting, supporting, and compressing a mine roof in an underground mine;

(b) a center aperture in said bearing plate for receiving a roof bolt when installed in said mine roof;

(c) apertures on said bearing plate for hanging cables and wires and "J" hooks;

(d) a recessed center on said bearing plate for concealing a head on said roof bolt when installed in said mine roof and for providing a lock washer effect on said roof bolt; and (e) a center recessed area on said bearing plate adapted to cause an outside rim to contact said mine roof first and then to compress said mine roof at a 30 to 45 degree angle.

2. The apparatus as set forth in claim 1, wherein said bearing plate is adapted to replace a base plate operating in conjunction with said bearing plate.

3. The apparatus as set forth in claim 2, wherein said bearing plate is elliptical with a circular configuration in the form of a plate.

4. The apparatus as set forth in claim 3, wherein said bearing plate features a center deflection with respect to a radial edge of said bearing plate such that said bearing plate is convex with respect to the mine roof surface.

5. The apparatus as set forth in claim 1, wherein said round or oval shaped dome is adapted to cause outer rim contact first.

6. The apparatus as set forth in claim 5, wherein said bearing plate features a center deflection with respect to the radial edge of said bearing plate such that said bearing plate is convex with respect to the mine roof surface.

7. In combination with a roof bolt used for primary roof support in an underground mine, the improvement comprising a round dome-shaped bearing plate, having an extended lateral surface for contacting an inside roof surface of an underground mine, and further defining an aperture therethrough such that said roof bolt can be passed through said bearing plate and said aperture of said bearing plate to secure said bearing plate to said inside roof surface of said underground mine, with said bearing plate interposed between said roof bolt and said inside roof surface of said underground mine, wherein said bearing plate has a substantially circular or elliptical configuration and a center deflection with respect to a radial edge of said bearing plate such that said bearing plate is convex with respect to said inside roof surface.

8. A method for providing a primary roof support in an underground mine, comprising the steps of:

(a) positioning a roof bolting machine in an area to be secured or bolted in an underground mine;

(b) drilling a hole into a mine roof through an immediate roof into an upper strata to a specified depth deeper than the length of a roof bolt being used;

c) inserting a plastic tube of epoxy resin and hardener into the drilled hole;

(d) inserting said roof bolt through an aperture of a roof bolt plate;

e) centering a bolt head on said roof bolt in a drill machine rotation head;

f) applying upward pressure and rotation as said roof bolt is pushed into said drilled hole in said roof, breaking the tube of epoxy resin and mixing the resin and hardener together and forcing the mixture into any cracks or separations in the strata;

(g) subsequently after the plate and bolt head reach within about an inch of the roof, stopping the upward pressure and remaining spinning, stopping the spinning motion and applying the full upward pressure of the bolting machine to push the roof bolt and center of the plate to compress the immediate roof, subsequently lowering the bolter head and observing the quality of installation by noticing the lock washer effect on the head of the bolt, and observing whether the bolt head lowers with the bolting machine, such that the installed bolt has lost its anchorage to form a failed bolt, then installing another bolt to replace the failed bolt, and moving to the next area in the underground mine to be secured; and (h) wherein said roof bolt plate features a round or oval dome-shaped plate and said specified depth is in a range of approximately three to four inches.

9. A method of supporting a roof in an underground mine comprising:

(a) providing a round or elliptical dome-shaped plate having an outer rim conforming to regular or irregular roof surfaces of an underground mine, and apertures for hanging cables, and further having a center aperture for receiving a roof bolt;

(b) providing a recessed center in said dome-shaped plate lower than said outer rim such that the head of said roof bolt will be partially protected, when installed in the roof of an underground mine;

(c) providing a plurality of ribs on the domed area of said dome-shaped plate for adjusting strength in said dome-shaped plate; and (d) inserting a roof bolt through said center aperture of said dome-shaped plate and into the roof of an underground mine.

10. A method of supporting a roof in an underground mine as set forth in claim 9, further comprising installing and monitoring plate effectiveness by the lock washer effect in the mine.

11. A method as set forth in claim 10, wherein said recessed center reduces injuries to personnel and damage to the roof control system by passing equipment.

12. A method as set forth in claim 9, wherein said recessed center reduces injuries to personnel and damage to the roof control system by passing equipment.

13. A method as set forth in claim 12, further comprising providing a system for hanging cables and wires and maintaining electrical cables and wires close to the roof, and out of harms way.

14. A method as set forth in claim 9, further comprising providing a system for hanging cables and wires and maintaining dangerous electrical cables and wires close to the roof, and out of harms way.

* * * * *